United States Patent [19]

Richardson

[11] Patent Number: 4,496,924

[45] Date of Patent: Jan. 29, 1985

[54] PULSE TRANSFORMER HAVING CONDUCTIVE SHIELD AROUND MAGNETIC CORE MATERIAL

[75] Inventor: Robert Richardson, Chelmsford, England

[73] Assignee: The Marconi Company Limited, Chelmsford, England

[21] Appl. No.: 402,344

[22] Filed: Jul. 27, 1982

[30] Foreign Application Priority Data

Aug. 8, 1981 [GB] United Kingdom ..... 8124320

[51] Int. Cl.[3] ..... H01F 15/04

[52] U.S. Cl. ..... 336/84 R; 336/84 C; 336/177

[58] Field of Search ..... 336/82, 84 C, 84 R, 336/177, 196, 198, 213

[56] References Cited

U.S. PATENT DOCUMENTS

| | | | |
|---|---|---|---|
| 2,901,714 | 8/1959 | Baker | 336/84 C X |
| 3,063,135 | 11/1962 | Clark | 336/84 C X |

FOREIGN PATENT DOCUMENTS

| | | | |
|---|---|---|---|
| 88529 | 5/1922 | Austria | 336/84 R |
| 661975 | 10/1928 | France | 336/84 R |
| 226174 | 6/1925 | United Kingdom . | |
| 419284 | 11/1934 | United Kingdom . | |
| 475129 | 11/1937 | United Kingdom . | |
| 990418 | 4/1965 | United Kingdom . | |
| 1353650 | 5/1974 | United Kingdom . | |

OTHER PUBLICATIONS

IEEE Transactions on Instrumentation and Measurement, vol. IM-24, No. 4, pp. 349-352, Dec. 1975.

*Primary Examiner*—A. D. Pellinen
*Assistant Examiner*—Susan Steward
*Attorney, Agent, or Firm*—Spencer & Frank

[57] ABSTRACT

A pulse transformer is used in a radar transmitter to transform a high current pulse at relatively low voltage into a very high voltage pulse which can be used to directly drive a magnetron oscillator. The potential of the output pulse can be of the order of 30 kV and since the transformer is required to operate at very high peak powers of the order of two megawatts, it must be very carefully designed to avoid excessive electrical losses and voltage breakdown. The core material of the transformer consists of a closely wound reel of magnetic material in the form of an elongate tape, which is mechanically fragile. The magnetic core is loosely mounted within a sealed container so that the primary and secondary windings surround it. A conductive shield is placed around the magnetic material so as to protect it from the very large electric fields generated within the transformer. This prevents the ionization of gases which could lead to the rapid deterioration of the magnetic core material.

10 Claims, 4 Drawing Figures

PULSE TRANSFORMER HAVING CONDUCTIVE SHIELD AROUND MAGNETIC CORE MATERIAL

BACKGROUND OF THE INVENTION

This invention relates to transformers which are particularly suitable for use in pulse circuits in which a high current pulse at relatively low voltage is converted into a very high voltage pulse. A transformer of this kind can be used in a pulse circuit to provide the operating power for a high power oscillator, such as a magnetron, which forms part of a radar transmitter. Such a pulse circuit is sometimes termed a radar pulse modulator. A radar transmitter can transmit pulses having a very low mark-to-space ratio; that is to say, transmitted short pulses are spaced apart in time by relatively long intervals during which echoes of the pulses are retuned by intercepted targets to a radar receiver. The useful range of a radar is related to the power transmitted during the short pulse periods and it is therefore very important to maximize the power of these pulses, whilst ensuring that the pulses turn on and turn off cleanly without the generation of excessive noise. Following the turn off, or decay, of a transmitted short pulse, the receiver of the radar is enabled so that it can detect weak radar echoes. It is clearly important to ensure that the trailing edges of the transmitted short pulses decay very rapidly and cleanly so that they do not mask echoes received after only a very short delay from targets at very close range.

These requirements impose stringent demands on the pulse transformer itself as it may be required to convert an input pulse of only a few hundred volts to an output pulse voltage of up to 30 kV or even higher, whilst handling a peak pulse power of the order of two megawatts. It has been found that pulse transformers designed to meet these operating requirements may not be entirely satisfactory and can deteriorate unexpectedly quickly during operational use. The present invention seeks to provide an improved transformer which is suitable for use in a pulse circuit.

SUMMARY OF THE INVENTION

According to this invention, a transformer includes a core material shaped to constitute a closed magnetic loop; a transformer primary winding and a secondary winding arranged in use to magnetically couple with said core material; and electrically conductive shielding means arranged to surround said core material so as to shield it from electric fields associated with the windings, and the shielding means having an electrical discontinuity so that it does not itself constitute a transformer winding; and wherein the core material is loosely mounted within the shield means to minimize mechanical stress imposed upon the core material; and the primary winding including a central conductor which is encircled by the core material, and a plurality of studs arranged on a circle lying outside of said secondary winding.

It has been found that some materials which are otherwise suitable for use as insulation mediums in transformers are susceptible to effects which occur when air and other gases are ionized by strong electric fields. It has not proved possible to overcome this difficulty by removing all voids from the region of the core material since to do so would entail encapsulating it in intimate contact with another material so that no free space was allowed to remain, and this would impose unacceptable mechanical stress upon the core material itself. Core material is relatively fragile and it is often advantageously formed as a closely wound reel of flexible elongate magnetic material which has a significantly large co-efficient of thermal expansion. The core material is mounted so that it is free to expand without causing mechanical stress which would severely damage it and impair the operation of the transformer. This is achieved by loosely mounting the core material within a sealed container containing residual air or another fluid which is electrically shield from the strong electric fields generated by the transformer winding, so that the gas does not ionize to any appreciable extent. The primary winding is configured in a way which enables it to carry large currents, and to contribute to the robustness of the transformer.

This invention is particularly suitable for use with a radar pulse modulator in which the transformer is required to convert low voltage pulses into high voltage pulses which are suitable for directly driving a magnetron oscillator. The peak powers can be very high indeed and accordingly the transformer must be very carefully designed to minimize losses.

BRIEF DESCRIPTION OF THE DRAWING

The invention is further described by way of example with reference to the accompanying drawings in which.

DESCRIPTION OF THE PREFERRED EMBODIMENT

Figure 1:
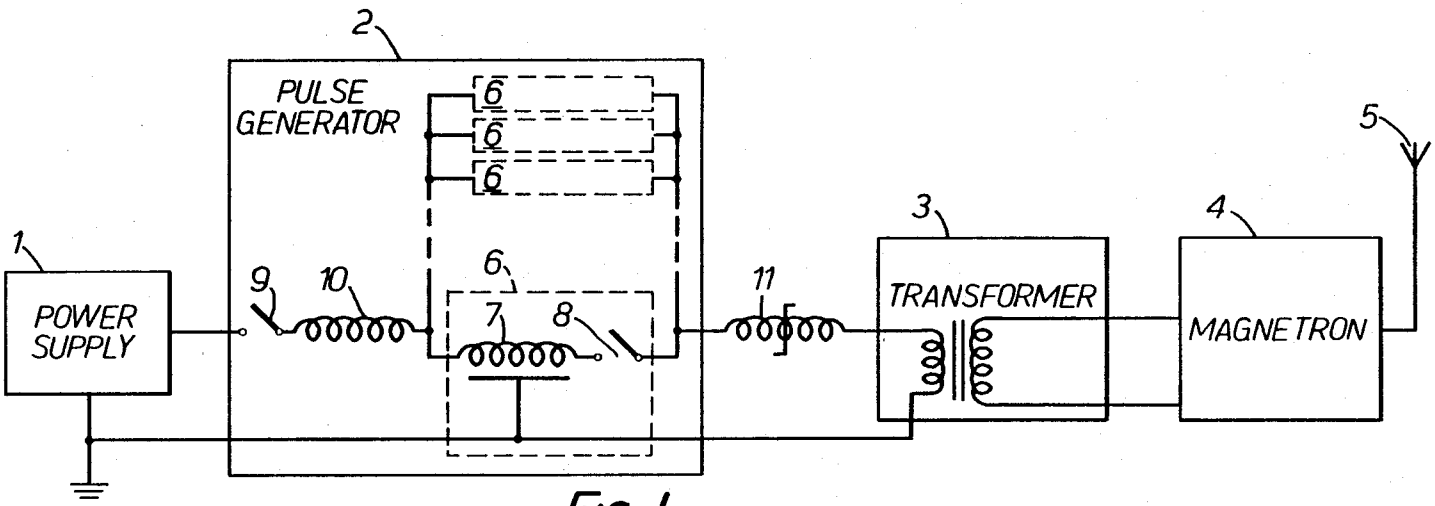
FIG. 1 shows a pulse circuit forming part of a radar transmitter and which incorporates a pulse transformer in accordance with the present invention.

FIG. 1 shows those parts of a radar transmitter which are relevant to an understanding of the present invention. The radar transmitter transmits very short pulses having a very high carrier frequency (usually in the microwave band) and during the interval (usually termed the inter-pulse period) following the cessation of each pulse, a radar receiver (not shown) receives relatively weak echoes of the transmitted pulse which is reflected by targets. The echoes may be very weak indeed and they are often difficult to detect from the background noise. Consequently, it is important that the radar transmitter itself does not generate electrical noise during the intervals between transmitted pulses. In order to maximize the level of the echo signals, the power of the transmitted pulses is made as large as possible, and the radar system must be designed with care to ensure that these pulses which have a very high power level decay very rapidly so that weak echo signals which occur immediately afterwards can be detected. Thus FIG. 1 shows just those parts of a radar transmitter which are concerned with the generation of very short but high power pulses.

A d.c. power supply 1 generates an output voltage of about 600 volts and applies it to a pulse generator 2 which is operative to utilize the d.c. voltage to produce a sequence of pulses having a low mark-to-space ratio corresponding to the pulses which are to be transmitted by the radar, but having a relatively low voltage, but very high current. These pulses are transformed by a pulse transformer 3 from the 600 volt level up to about 30 kV so that they can be used to drive a magnetron 4 directly. A magnetron is a relatively efficient and satisfactory generator of microwave power, but it requires the provision of a high operating voltage. The output of the magnetron 4 is transmitted via a radar antenna 5. The magnetron 4 is such as to oscillate at microwave frequencies whenever a sufficiently high voltage is applied to it, and the shape of the transmitted pulses and the efficiency with which they are transmitted is primarily dependent on the nature of the pulses generated at the pulse generator 2 and the way in which they are transformed from a low voltage to a high voltage by the transformer 3.

The pulse generator 2 utilizes a number of pulse forming networks to generate an output pulse having the required characteristic. A pulse forming network consists of a distributed network of inductance and capacitance, and during the interpulse periods the network is charged from the power supply 1 at a relatively low current level. As the inter-pulse periods are long compared to the pulse periods themselves, the pulse forming networks are able to accumulate a great deal of energy. A mark-to-space ratio of the order of 1 to 1000 is typical of many radars. When an output pulse is required the pulse forming network are discharged rapidly, but the characteristics of the pulse forming networks enable relatively square pulses to be produced—that is to say, a flat-topped pulse having very steep rising and falling edges.

It is these pulses which are transformed by the transformer 3 to the high voltage of about 30 kV which is necessary to drive the magnetron 4. It will be appreciated that the switches which are used to discharge the pulse forming networks must conduct a great deal of current and must be relatively robust and reliable. In FIG. 1, these switches are constituted by thyristors, which are solid state devices and which at the present time cannot reliably withstand voltages much greater than 1000 volts. Therefore in order to achieve the necessary power levels a number of pulse forming networks together with their respective switches are connected in parallel. Typically, at least eight such pulse forming networks are connected in parallel.

Only one of the pulse modules 6 is shown in detail, but all are identical to each other. Each module 6 consists of a pulse forming network 7 comprising a network of distributed inductance and capacitance, connected in series with a thyristor 8. The modules 6 are connected in parallel with each other, and to the power supply 1 via a common switch 9 and a choke 10. The modules 6 are coupled to the primary winding of the transformer 3 via a saturable reactor 11.

Briefly, the operation of the radar system shown in FIG. 1 is as follows. Initially, the switches 8 and 9 are non-conductive and the pulse forming networks 7 are assumed to be fully discharged. Switch 9 is then closed so that all of the pulse forming networks 7 are charged from the 600 volt d.c. power supply 1 via the choke 10—the choke 10 is merely present to moderate the magnitude of the initial charging current when the switch 9 is first closed. The pulse forming networks 7 charge during the inter-pulse period, which can be relatively long so that they become fully charged. When an output pulse is required the switches 8 are rendered conductive. As the switches 8 are solid state thyristors they take a finite time to change from a fully non-conductive state to a fully conductive state, and if appreciable current were allowed to flow through them during the transition phase a great deal of power would be dissipated within them. To prevent this happening the saturable reaction 11 is provided—it initially behaves as an inductor and therefore controls the rate at which the build up of current can occur, but it rapidly saturates and then behaves as a very low value inductance. The time taken to saturate is tailored to the switching time of the switches 8 so that once the switches 8 are fully conductive, the saturable reactor 11 appears in effect as a virtual short circuit allowing the pulse forming networks 7 to very rapidly discharge. This rapid discharge is a high current pulse which is transformed by the transformer 3 up to the required operating voltage of the magnetron—typically about 30 kV.

Figure 3:
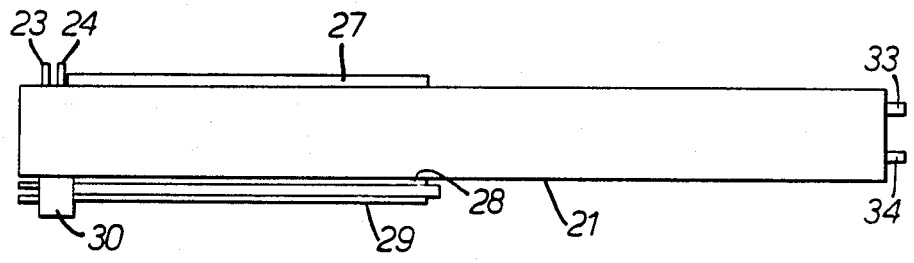
Figure 4:
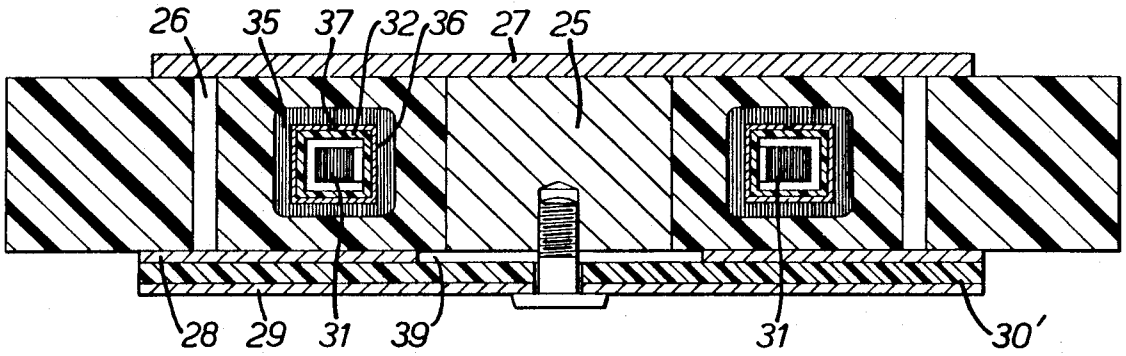
FIG. 4 shows a sectional view taken on the line X-Y of FIG. 2.

For such an application the pulse transformer must be capable of providing output pulses of up to 30 kV and even though its losses are minimized it may be required to dissipate power of the order of 50 watts. Furthermore, so that it does not adversely degrade the shape of the pulses produced by the pulse forming networks, it is important that the pulse transformer itself exhibits very low interconnection inductance values. Suitable magnetic material has a significantly high co-efficient of thermal expansion and magnetic properties that are effected by strain effects so the material must be mounted in such a way that its expansion when hot does not cause mechanical fatigue. One suitable material consists primarily of about 50% nickel and 50% iron—it exhibits a square magnetic B-H hysteresis loop and a high magnetic flux density. Under conditions of high electric field strength it has been found that any free space remaining around the core material will with time ionize and cause damage to the transformer insulation. The construction of the transformer in accordance with this invention which enables the diverse design constraints to be met is shown in FIGS. 2, 3 and 4.

The transformer consists of a primary winding having only a single turn, and a secondary winding having many turns which generate the required high voltage output pulses. The low voltages associated with the primary winding are applied to the transformer at its base 20 via printed circuit board connections which are clamped to a major surface 21 of the transformer. In the present application, the transformer is used to drive a magnetron in which its cathode is driven to −30 kV with respect to its anode. It is necessary to provide power at this potential to heat the cathode. This is conveniently achieved by providing the secondary winding in two portions, each portion having a respective low potential terminal 23 and 24 at the base of the transformer housing, and a respective high potential terminal 33 and 34 at the other end of the transformer housing. In operation a d.c. potential difference of about 20 volts is applied between the terminals 23 and 24, and thus the cathode heater, which is connected between terminals 33 and 34 receives this voltage continuously.

Figure 2:
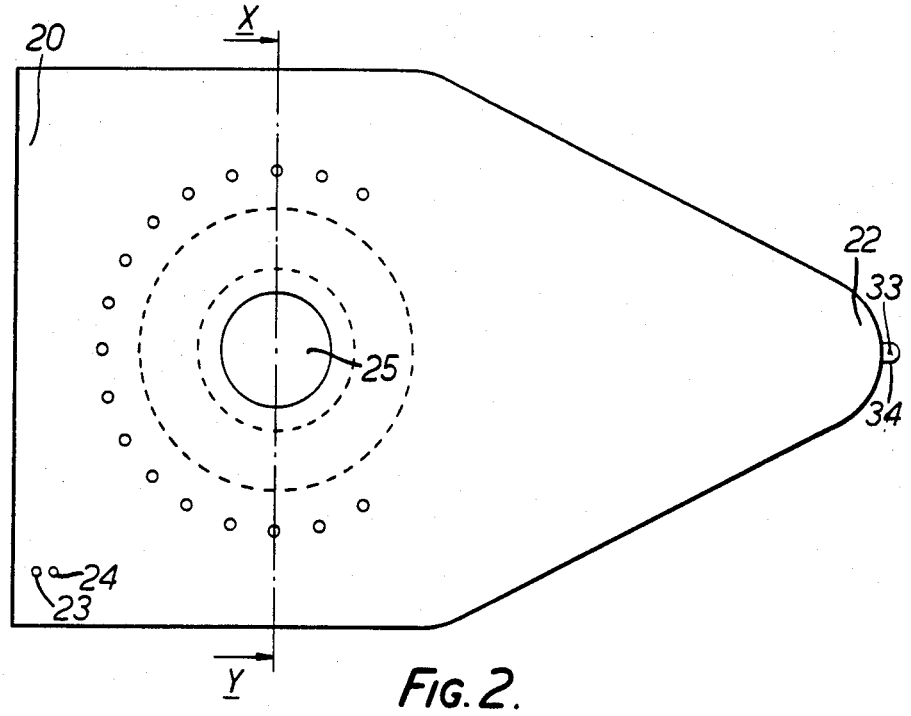
FIGS. 2 and 3 show a plan view and side elevation view of the transformer.

The transformer housing is shaped as shown in FIG. 2 to enable the high voltage terminals 33, 34 to be spaced well away from the other parts of the transformer to reduce risk of electrical breakdown and surface tracking.

The transformer contains a primary winding, which has a single loop and which consists of a central solid conductive bush 25 and a large number of conductive studs 26 arranged in a circle around it. Conductive layers 27, 28 and 29 interconnect the studs 26 and the large central bush 25 to complete the primary winding. Electrical connections are made to the layers 28 and 29 by means of a connector 30 which is attached to one outer surface of the pulse transformer; and the two layers 28 and 29 are formed on the opposite sides of a single insulating printed circuit board 30'. The conductive layer 28 which is immediately adjacent to the body of the transformer is provided with a circular cut-out in the region 39 so that this layer does not make direct contact to the central bush 25 as this would short-out the primary winding. Thus the central bush 25, the studs 26 and the three layers 27, 28 and 29 constitute a primary winding having only a single turn. Such a winding can be made in a very robust fashion and can carry very large currents, whilst the use of printed circuits for layers 28, 29 which can have a very large area enable its inductance to be minimized. In particular, the flow and return current paths are very close to each other.

The magnetic core material of the transformer is formed as an annular ring 31, which is made up of a large number of turns of thin flat tape. This tape is relatively fragile but has a significantly large co-efficient of thermal expansion as previously stated. The core 31 is enclosed within a sealed annular container 32, which is composed of a plastics material. The container 32 is hermetically sealed by means of a suitable sealant and is sufficient large so that the core 31 is only loosely held within it. The core 31 is free to move slightly and is able to expand without mechanical constaint which would impose stress upon it. The annular container 32 contains residual gas such as air and a small quantity of a fluid, such as silicone oil, which provides a degree of mechanical damping. In order to prevent the residual gas within the container 32 being ionized by the very high voltages associated with the transformer, the outer surface of the container is coated with a thin layer 36 of good electrically conductive material. This provides a complete electro-static screen, but to prevent the coating 36 behaving as an electrical winding itself an annular electrical discontinuity 37 is machined in its surface. This prevents the generation of circulating eddy currents which would represent large electrical looses. In this event the layer 36 would itself act as a transformer winding, and this must be prevented. The secondary winding 35 is then wound as a toroidal coil around the container 32. As previously explained, it is wound in two parts to enable it to carry the current which heats the cathode of the magnetron. In order to improve the high voltage stability of the assembly, it is preferable to provide a substantial layer of an electrical insulating material (not separately shown) between the secondary winding 35 and the conductive coating 36.

The assembly as so far described is supported in position so that the secondary winding is held correctly relative to the primary turn by an electrical insulating epoxy resin which is cast around it to produce a moulded transformer having a smooth outer surface in the shape of the outline shown in FIGS. 1 and 2. The epoxy resin is one which has a low dielectric loss, high electrical strength, and good mechanical and thermal stability.

I claim:

1. A transformer, comprising: a core material shaped to constitute a closed magnetic loop; a transformer primary winding and a secondary winding arranged in use to magnetically couple with said core material; and electrically conductive shielding means arranged to surround said core material for shielding it from electric fields associated with the windings, and the shielding means having an electrical discontinuity so that it does not itself constitute a transformer winding; and wherein the core material is loosely mounted within the shielding means to minimize mechanical stress imposed upon the core material; and wherein the primary winding includes a central conductor which is encircled by the core material, and a plurality of studs arranged on a circle lying outside of said secondary winding, at least a major portion of the primary current flowing through said studs.

2. A transformer as claimed in claim 1, wherein the core material is sealed in a closed hollow annular container having a shape and size slightly larger than the core material itself.

3. A transformer as claimed in claim 2, wherein the outer surface of the container is provided with an electrically conductive coating to constitute said shielding means.

4. A transformer as claimed in claim 3, wherein the discontinuity is a single continuous interruption of the coating.

5. A transformer as claimed in claim 3 or 4, wherein the secondary winding is a high voltage winding which is wound around the container and spaced apart from the electrically conductive coating by intervening electrically insulating material.

6. A transformer as claimed in claim 5, wherein the primary winding is a single turn low voltage winding.

7. A transformer as claimed in claim 6, wherein the transformer windings are held in place by a settable resin which is moulded around them.

8. A transformer as claimed in claim 6, wherein a conductive plate is provided to electrically link one end of each of the studs with the central conductor, and wherein a double sided printed circuit board is provided in contact with the other ends of each of the studs and the central conductor so that a conductive surface on one side of the printed circuit board makes electrical connection to said studs and a conductive surface on the other side of the printed circuit board makes electrical connection to said central conductor.

9. A transformer as claimed in claim 7, wherein a conductive plate is provided to electrically link one end of each of the studs with the central conductor, and wherein a double sided printed circuit board is provided in contact with the other ends of each of the studs and the central conductor so that a conductive surface on one side of the printed circuit board makes electrical connection to said studs and a conductive surface on the other side of the printed circuit board makes electrical connection to said central conductor.

10. A transformer as claimed in claim 1, wherein said central conductor and studs of said primary winding are dimensioned for operation of said transformer at high peak power levels and at high frequency.

* * * * *